US009208962B2

(12) United States Patent
Bose et al.

(10) Patent No.: US 9,208,962 B2
(45) Date of Patent: Dec. 8, 2015

(54) CIRCUIT BREAKER INCLUDING AN ANTI-REBOUND SYSTEM, ANTI-REBOUND SYSTEM FOR A CIRCUIT BREAKER AND METHOD

(71) Applicant: General Electric Company, Schenectady, NY (US)

(72) Inventors: Amit Bose, Andhra Pradesh (IN); Anurag Arjundas Jivanani, Unionville, CT (US); Soundararajan Narayanasamy, Andhra Pradesh (IN); Yatin Vilas Newase, Maharashtra (IN)

(73) Assignee: GENERAL ELECTRIC COMPANY

( * ) Notice: Subject to any disclaimer, the term of this patent is extended or adjusted under 35 U.S.C. 154(b) by 120 days.

(21) Appl. No.: 14/090,348

(22) Filed: Nov. 26, 2013

(65) Prior Publication Data

US 2015/0144471 A1 May 28, 2015

(51) Int. Cl.
*H01H 1/52* (2006.01)
*H01H 9/20* (2006.01)

(52) U.S. Cl.
CPC ..... *H01H 9/20* (2013.01)

(58) Field of Classification Search
CPC ..... H01H 71/504–77/104
USPC ..... 200/232, 324, 327, 288; 335/46
See application file for complete search history.

(56) References Cited

U.S. PATENT DOCUMENTS 4,114,513 A * 9/1978 Debrus ..... 91/19
4,144,513 A 3/1979 Shaffer et al.
4,263,492 A 4/1981 Maier et al.
4,611,187 A 9/1986 Banfi
4,612,430 A 9/1986 Sloan et al.
4,638,277 A * 1/1987 Thomas et al. ..... 335/190
4,713,503 A 12/1987 Kamp
5,743,385 A * 4/1998 Godesa ..... 200/401
5,912,605 A 6/1999 Eberts
6,084,489 A 7/2000 Castonguay et al.
6,492,888 B2 12/2002 Dahl et al.
6,831,240 B2 12/2004 Bach et al.

(Continued)

FOREIGN PATENT DOCUMENTS

CN 102054631 A 5/2011
CN 201985050 U 9/2011

(Continued)

OTHER PUBLICATIONS

English Abstract of Indian Patent Application No. 738/MUM/2008, published Mar. 20, 2009, 1 page.

(Continued)

*Primary Examiner* — Vanessa Girardi
(74) *Attorney, Agent, or Firm* — GE Global Patent Operation; Stephen G. Midgley

(57) ABSTRACT

A circuit breaker includes a housing, a stationary pole member fixedly mounted in the housing, a moveable pole member shiftably mounted within the housing, and a drive shaft mounted to the housing and operatively connected to the moveable pole member. An inertia latch stop member is mounted to the housing adjacent the drive shaft and an inertia latch is operatively connected to the drive shaft. The inertia latch is configured and disposed to extend from the drive shaft and engage the inertia latch stop member in response to a change in direction of rotation of the drive shaft from an opening direction to a closing direction following a trip event.

10 Claims, 6 Drawing Sheets

(56) References Cited

U.S. PATENT DOCUMENTS

| | | | |
|---|---|---|---|
| 6,870,112 | B2 | 3/2005 | Bresciani et al. |
| 8,378,242 | B2 | 2/2013 | Kim |
| 2010/0230261 | A1 | 9/2010 | Kim |

FOREIGN PATENT DOCUMENTS

| | | | |
|---|---|---|---|
| CN | 202013857 | U | 10/2011 |
| DE | 20121223 | U1 | 3/2003 |
| JP | 11312452 | A | 11/1999 |
| JP | 2001093388 | A | 4/2001 |
| JP | 2002150915 | A | 5/2002 |

OTHER PUBLICATIONS

English Abstract of Indian Patent Application No. 784/CHE/2010, published Sep. 30, 2011, 1 page.

* cited by examiner

CIRCUIT BREAKER INCLUDING AN ANTI-REBOUND SYSTEM, ANTI-REBOUND SYSTEM FOR A CIRCUIT BREAKER AND METHOD

BACKGROUND OF THE INVENTION

The subject matter disclosed herein relates to the art of circuit breakers and, more particularly, to a circuit breaker including an anti-rebound system, an anti-rebound system for a circuit breaker and a method.

A circuit breaker includes stationary and moveable contacts that are connected to close a circuit to pass electrical current. In the event that the electrical current exceeds predetermined parameters, such as during a short circuit event, the moveable contacts are shifted away from the stationary contacts to open the circuit. A high amperage rating air circuit breaker at high short circuit currents may experience very high contact opening forces. Accordingly, the moveable contact may rebound back towards the stationary contact after opening. Circuit breakers having a high current interruption rating, for example, a current interruption rating upwards of 150 KA and greater, generates very high constriction force on the contact assembly. This high force drives the moveable contact away from the stationary contact toward a stop pin. In some cases, the moveable contact, after impacting the stop pin, travels back towards the stationary contact and may momentarily re-close the circuit.

BRIEF DESCRIPTION OF THE INVENTION

According to one aspect of an exemplary embodiment, a circuit breaker includes a housing, a stationary pole member fixedly mounted in the housing, a moveable pole member shiftably mounted within the housing, and a drive shaft mounted to the housing and operatively connected to the moveable pole member. An inertia latch stop member is mounted to the housing adjacent the drive shaft and an inertia latch is operatively connected to the drive shaft. The inertia latch is configured and disposed to extend from the drive shaft and engage the inertia latch stop member in response to a change in direction of rotation of the drive shaft from an opening direction to a closing direction following a trip event.

According to another aspect of the exemplary embodiment, an anti-rebound system for a circuit breaker includes a drive shaft, an inertia latch stop member mounted adjacent the drive shaft, and an inertia latch operatively connected to the drive shaft. The inertia latch is configured and disposed to extend from the drive shaft and engage the inertia latch stop member in response to a change in direction of rotation of the drive shaft from an opening direction to a closing direction following a trip event of the circuit breaker.

According to yet another aspect of the exemplary embodiment, a method of arresting rebound of a moveable pole member in a circuit breaker includes rotating a drive shaft in an opening direction to shift the moveable pole member away from a stationary pole member to interrupt a circuit, arresting rotation of the drive shaft in the opening direction causing a rebound of the drive shaft towards a closing direction creating an inertial force, deploying an inertia latch in response to the inertial force, and arresting rotation of the drive shaft in the closing direction to prevent the moveable pole member from connecting with the stationary pole member.

These and other advantages and features will become more apparent from the following description taken in conjunction with the drawings.

BRIEF DESCRIPTION OF DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
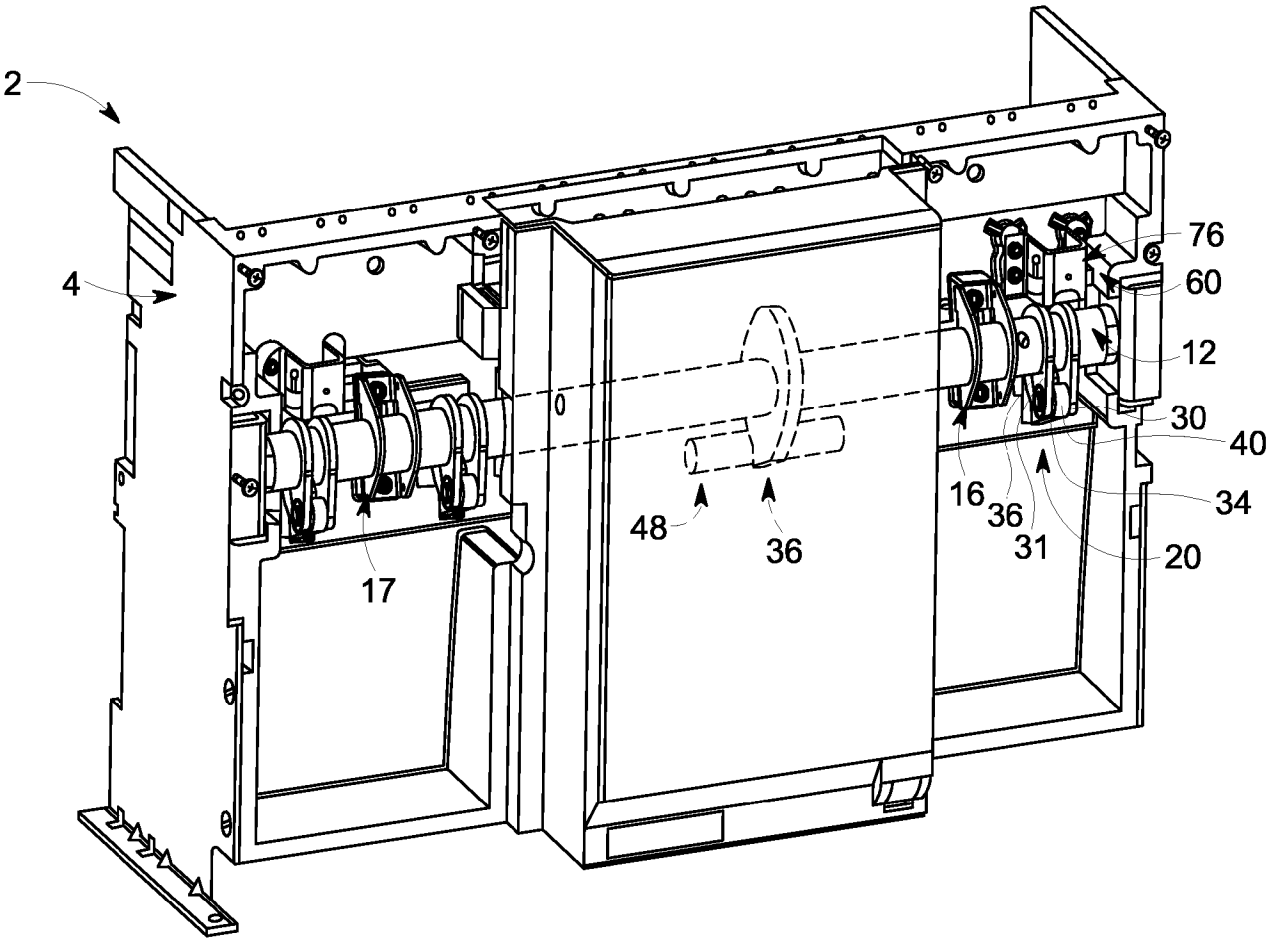
FIG. 1 is a partially disassembled perspective view of a circuit breaker having an anti-rebound system, in accordance with an exemplary embodiment.
Figure 2:
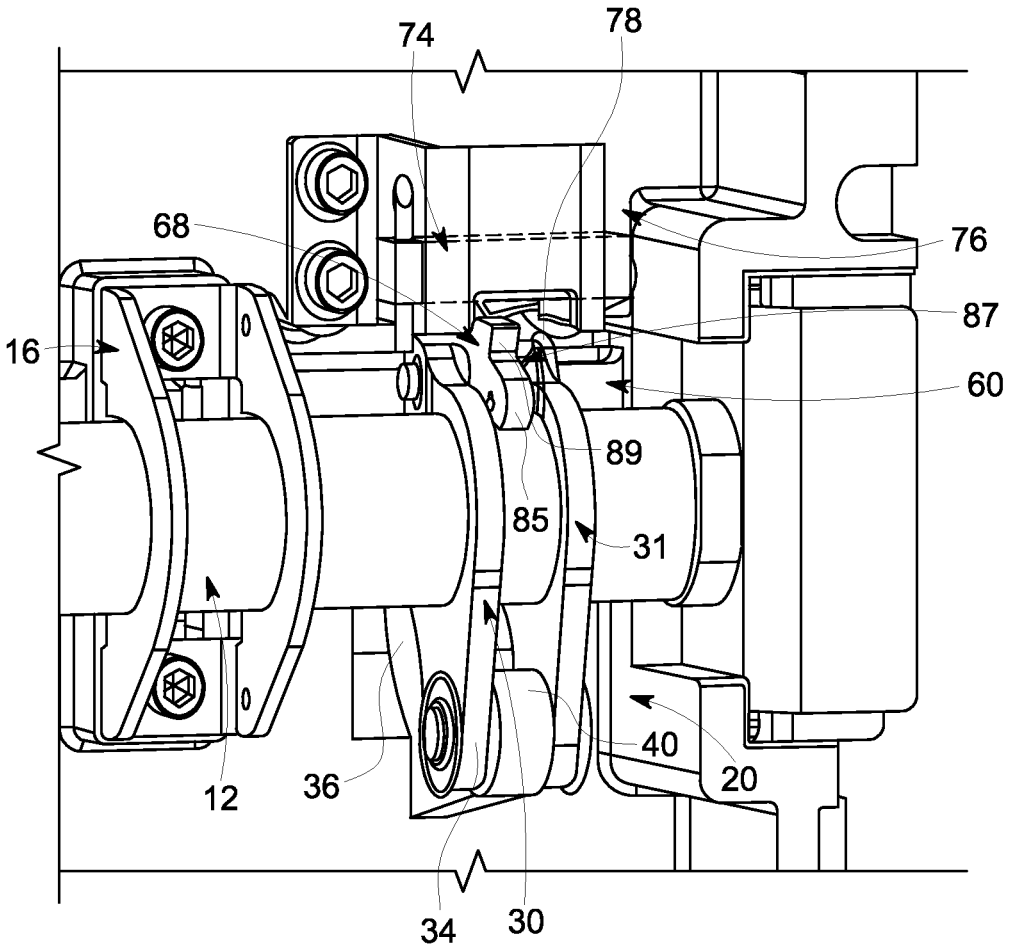
FIG. 2 is a perspective view of the anti-rebound system of FIG. 1.

A circuit breaker, in accordance with an exemplary embodiment, is indicated generally at 2, in FIGS. 1 and 2. Circuit breaker 2 includes a housing 4 that surrounds a number of stationary pole members, one of which is shown at 6 in FIG. 3, and a plurality of moveable pole members, one of which is shown at 8 in FIG. 3. Moveable pole member 8 is selectively shifted into and out of contact with stationary pole member 6 to close and open a circuit through rotation of a drive shaft 12. Rotating drive shaft 12 in a closing direction shifts moveable pole member 8 into contact with stationary pole member 6 to close the circuit. Rotating drive shaft 12 in an opening direction shifts moveable pole member 8 away from stationary pole member 6 to open the circuit. Drive shaft 12 may be rotated manually or automatically in response to a tip event. A trip event may include a short circuit in one or more phases of an electrical system (not shown).

Drive shaft 12 is rotatably mounted to housing 4 through a first support member 16 and a second support member 17. In addition, drive shaft 12 includes a plurality of lever assemblies, one of which is indicated at 20, that interface with each moveable pole member 8. Lever assembly 20 includes a first lever 30 fixedly mounted to drive shaft 20. Lever assembly 20 also includes a second lever 31 fixedly mounted to drive shaft 12 adjacent to, and spaced from, first lever 30 through a gap (not separately labeled). Lobe 34 is a different lever on the drive shaft 12. Each lever 30 and 31 includes a lobe 34. First lobe 34 is pivotally connected to moveable pole member 8 through a pole coupler 40. A second or stop lever 36 is mounted centrally along drive shaft 12. Stop lever 36 includes a second or stopping lobe 38 having a stop pin engagement surface 44 that engages with a stop pin 48 mounted relative to housing 4. Stop pin 48 interacts with stopping lobe 38 to arrest rotation of drive shaft 12 in the opening direction following a trip event.

Figure 3:
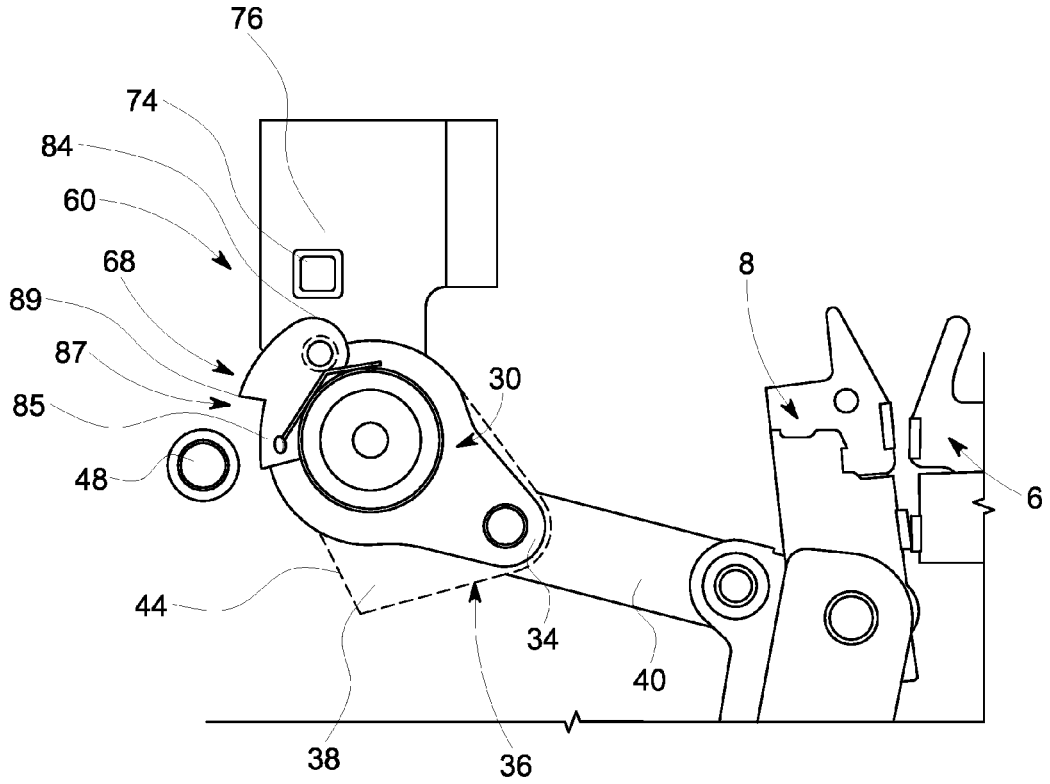
FIG. 3 is a side plan view of the circuit breaker of FIG. 1 shown in a closed position.

In accordance with an exemplary embodiment, circuit breaker 2 includes an anti-rebound system 60 that prevents moveable pole member 8 from re-engaging with stationary pole member 6 following a trip event, as will be detailed more fully below. Anti-rebound system 60 includes an inertia latch 68 and a stop member 74. Inertia latch 68 is pivotally mounted to drive shaft 12 between first and second levers 30 and 31. Stop member 74 is mounted to housing 4 through a support bracket 76. Inertia latch 68 is selectively maintained in a non-deployed position, such as shown in FIG. 3, by a biasing spring 78. Inertia latch 68 extends from a first end 84 to a second end 85. First end 84 is pivotally mounted between first and second levers 30 and 31. Second end 85 includes a stepped portion 87 having a stop member engagement surface 89.

Figure 4:
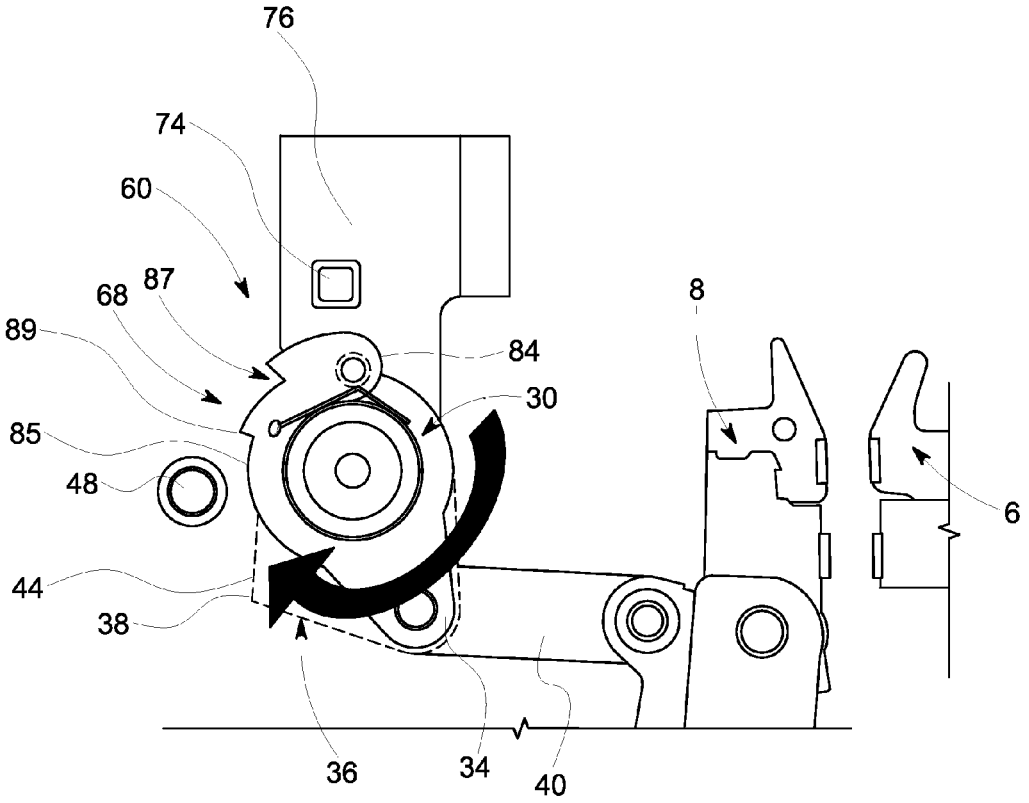
FIG. 4 is a side plan view of the circuit breaker of FIG. 3 shifting to an open position in response to a trip condition through rotation of a drive shaft.
Figure 5:
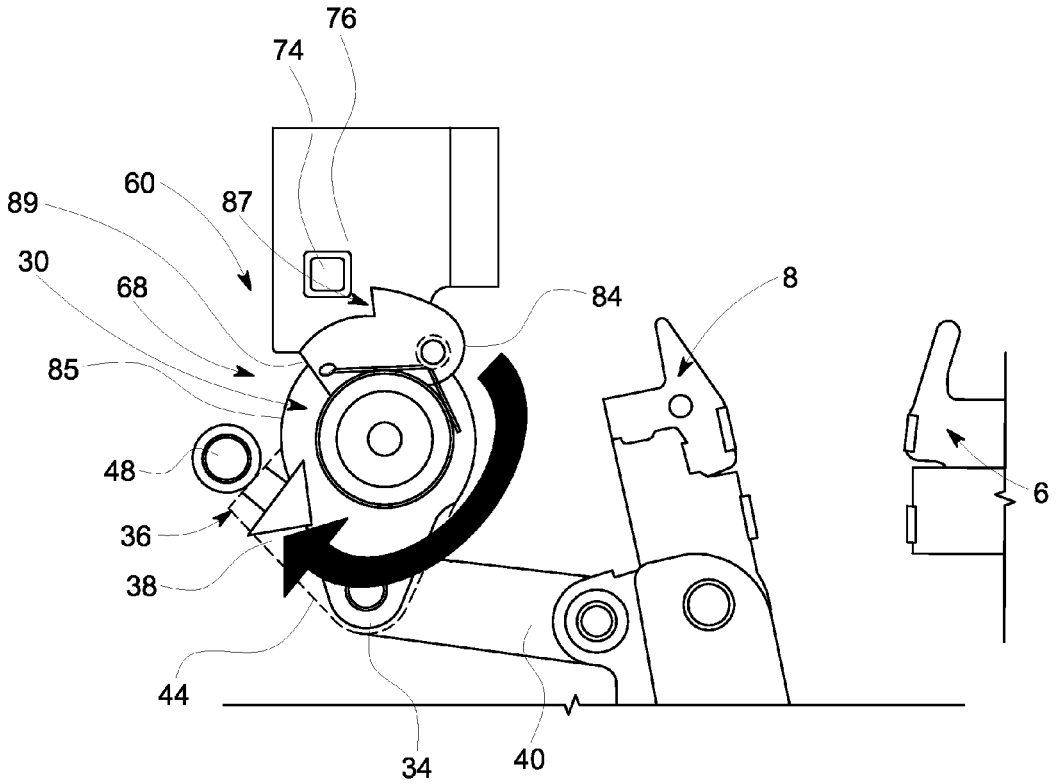
FIG. 5 is a side plan view of the circuit breaker of FIG. 4 rebounding off of a stop pin.
Figure 6:
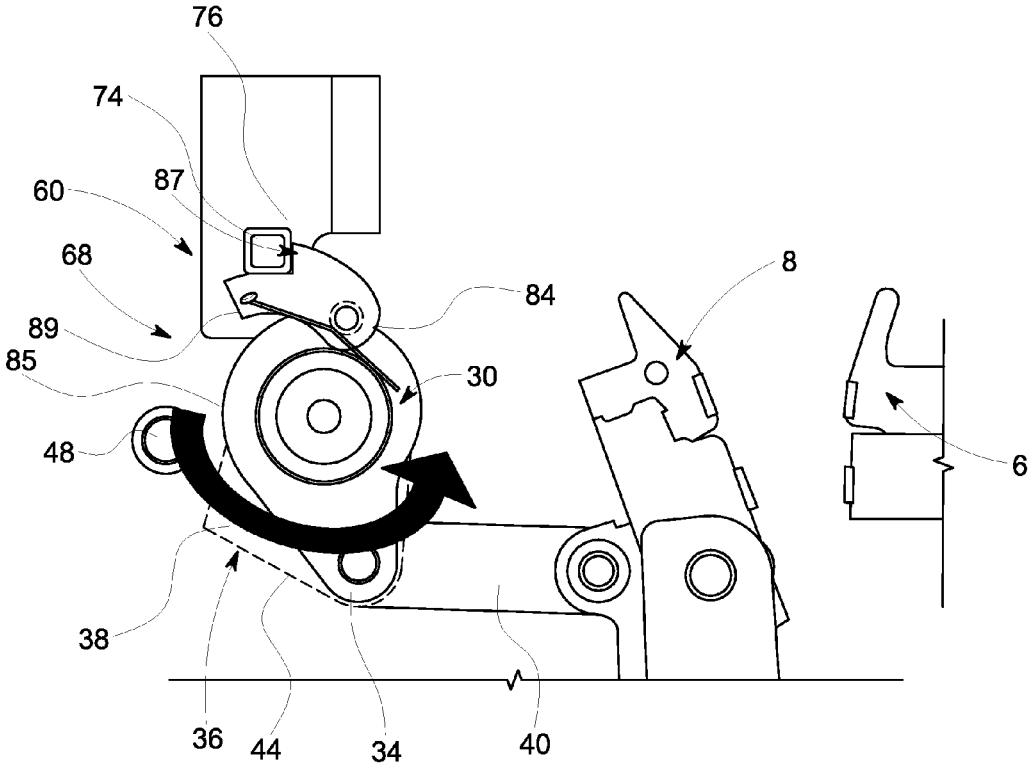
FIG. 6 is a side plan view of the circuit breaker of FIG. 5 deploying the anti-rebound system to arrest rotation of the drive shaft.

Reference will now follow to FIGS. 4-6 in describing operation of anti-rebound system 60. After a trip event, drive shaft 12 rotates from the opening direction, as shown in FIG. 4, to disengage moveable pole member 8 and stationary pole member 6. In the opening direction, stop lever 36 rotates toward stop pin 48. Once stop pin engagement surface 44 on stopping lobe 38 contacts stop pin 48, drive shaft 12 rebounds from the opening direction to the closing direction, as shown in FIG. 5. More specifically, the force employed to disengage moveable pole member 8 from stationary pole member 6 is such that stopping lobe 38 rebounds from stop pin 48 causing drive shaft 12 to rapidly change direction and rotate back toward the closing direction. The rapid change in direction generates an inertial force that causes inertia latch 68 to overcome biasing spring 78 and rotate outward to a deployed position.

In the deployed position, inertia latch 68 engages with stop member 74 to momentarily arrest rotation of drive shaft 12 in the closing direction. The momentary arrest facilitates a dissipation of energy causing drive shaft 12 to move to a tripped position. In accordance with the exemplary embodiment, stop member engagement surface 89 exerts a pushing force on stop member 74 momentarily arresting rotation of drive shaft 12 and prevent moveable pole member 8 from re-contacting stationary pole member 6.

At this point it should be understood that the exemplary embodiment provides a system that facilities a clean trip of a circuit breaker. A clean trip should be understood to describe a trip in which a circuit is opened without bounce back or a restrike. The exemplary embodiment may be employed in circuit breakers having high current interruption ratings, for example, circuit interruption ratings up to 150 KA or more. In such circuit breakers, constriction forces are significant and can create a rebound condition that, if left unchecked, could lead to arcing or other negative consequences of a re-strike. The anti-rebound system of the present invention eliminates re-strike by arresting rotation of the drive shaft in the closing direction following a trip event. It should also be understood that the number and location of anti-rebound systems may vary depending on, for example, circuit breaker size and current rating.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A circuit breaker comprising:

a housing;

a stationary pole member fixedly mounted within the housing;

a moveable pole member shiftably mounted within the housing;

a drive shaft mounted to the housing and operatively connected to the moveable pole member;

an inertia latch stop member mounted to the housing adjacent the drive shaft; and an inertia latch comprising a first end pivotally coupled to the drive shaft, and a second end having an engagement surface configured and disposed to selectively engage the inertia latch stop member in response to a change in direction of rotation of the drive shaft from an opening direction to a closing direction following a trip event; and at least one lever fixedly mounted to the drive shaft and operatively connected to the moveable pole member, the first end of the inertia latch pivotally coupled to the at least on lever.

2. The circuit breaker according to claim 1, further comprising: a biasing spring operatively connected to the inertia latch, the biasing spring being configured and disposed to selectively constrain the inertia latch in a non-deployed position.

3. The circuit breaker according to claim 1, wherein the at least one lever includes a first lever spaced from a second lever, each of the first and second levers being fixedly mounted to the drive shaft and operatively connected to the moveable pole member, the inertia latch stop member being arranged between and pivotally connected to the first and second levers.

4. The circuit breaker according to claim 1, wherein the at least one lever is operatively connected to the moveable pole member through a pole coupler.

5. The circuit breaker according to claim 1, further comprising: a stop lever mounted to the drive shaft, the stop lever including a stopping lobe configured and disposed to engage with a stop pin to constrain rotation of the drive shaft in the opening direction.

6. An anti-rebound system for a circuit breaker comprising:

a drive shaft;

an inertia latch stop member mounted adjacent the drive shaft; and an inertia latch having a first end pivotally mounted to the drive shaft, and a second end including a stepped portion and an engagement surface at the stepped portion, configured and disposed to engage the inertia latch stop member in response to a change in direction of rotation of the drive shaft from an opening direction to a closing direction following a trip event of the circuit breaker.

7. The anti-rebound system according to claim 6, further comprising: a biasing spring operatively connected to the inertia latch, the biasing spring being configured and disposed to selectively constrain the inertia latch in a non-deployed position.

8. The anti-rebound system according to claim 6, further comprising: a stop lever mounted to the drive shaft, the stop lever including a stopping lobe configured and disposed to engage with a stop pin to constrain rotation of the drive shaft in the opening direction.

9. The anti-rebound system according to claim 6, further comprising: at least one lever fixedly mounted to the drive shaft, the first end of the inertia latch being pivotally coupled to the at least one lever.

10. The anti-rebound system according to claim 9, wherein the at least one lever includes a first lever spaced from a second lever, each of the first and second levers being fixedly mounted to the drive shaft, the inertia latch being arranged between and pivotally connected to the first and second levers.

* * * * *